United States Patent [19]

Reddy

[11] Patent Number: 4,611,104

[45] Date of Patent: Sep. 9, 1986

[54] ELECTROMECHANICAL SWITCH ACTUATOR HAVING HIGH SECURITY KEY ACTUATOR

[75] Inventor: Redreddy S. Reddy, Evanston, Ill.

[73] Assignee: Vapor Corporation, Chicago, Ill.

[21] Appl. No.: 784,486

[22] Filed: Oct. 4, 1985

[51] Int. Cl.[4] ..... H01H 27/08

[52] U.S. Cl. ..... 200/43.08; 200/308

[58] Field of Search ..... 200/43.08, 43.04, 43.01, 200/334, 336, 308, 61.64; 70/432, 441, 345, 346

[56] References Cited

U.S. PATENT DOCUMENTS

| | | | |
|---|---|---|---|
| 1,434,031 | 10/1922 | Wallace | 200/43.08 |
| 1,641,352 | 9/1927 | Norviel | 200/43.08 |
| 1,675,737 | 7/1928 | Teich | 200/43.08 |
| 3,024,338 | 3/1962 | Nelson | 200/336 |
| 3,095,725 | 4/1963 | Unsworth | 70/346 |
| 3,160,720 | 12/1964 | Faulkner | 200/43.08 |
| 3,435,643 | 4/1969 | Pollak et al. . | |
| 3,561,160 | 2/1971 | Chan . | |
| 3,629,530 | 12/1971 | Fischer | 200/43.08 |
| 3,723,682 | 3/1973 | Pecott | 200/61.64 |
| 4,147,905 | 4/1979 | Scherbing | 200/43.08 |
| 4,153,826 | 5/1979 | Reddy | 200/43.08 |
| 4,424,424 | 1/1984 | Hollenbeck, Jr. | 200/43.08 |

FOREIGN PATENT DOCUMENTS

| | | | |
|---|---|---|---|
| 292806 | 7/1965 | Netherlands | 200/43.08 |

*Primary Examiner*—Stephen Marcus
*Assistant Examiner*—Renee S. Luebke
*Attorney, Agent, or Firm*—Fitch, Even, Tabin & Flannery

[57] ABSTRACT

An electromechanical switch actuator operated by a detachable, mechanical key providing security against unauthorized operation. The switch actuator disclosed is of particularly rugged construction, arranged to provide rotary torque for operating axially coupled electromechanical rotary switches having a plurality of switch banks or stacks disposed along a central axis. Switch operation is provided for any predetermined number of switch positions with non-electric indication of said positions, both by visual observation of the key entry area, and the key position. Key operating forces are converted entirely to rotational torque for switch operation and positive rotary motion limits independent of the electrical switch provide substantially increased switch life.

5 Claims, 11 Drawing Figures

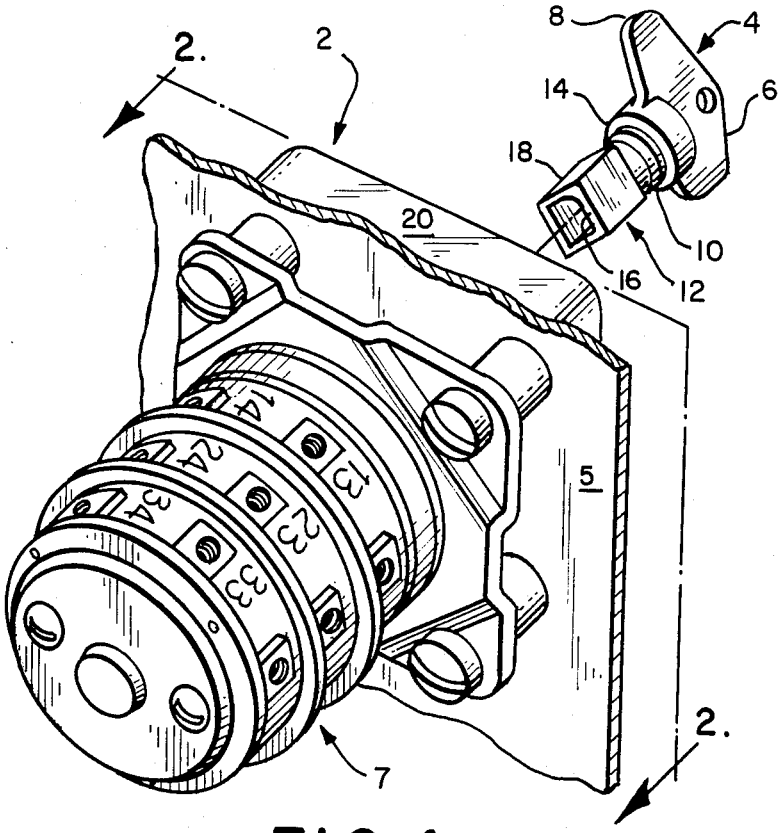
FIG. 1
FIG. 3
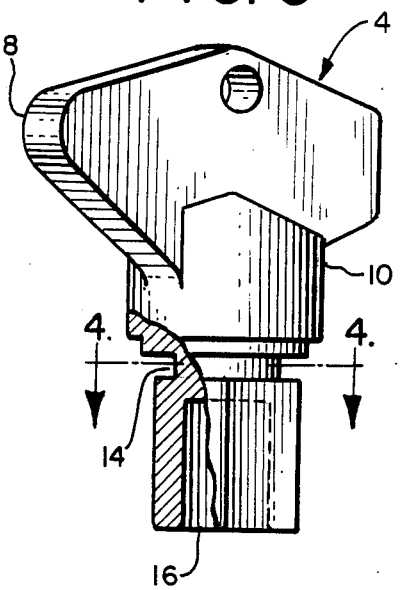
FIG. 4
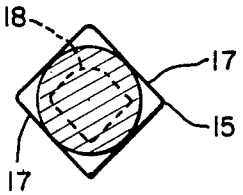
FIG. 2
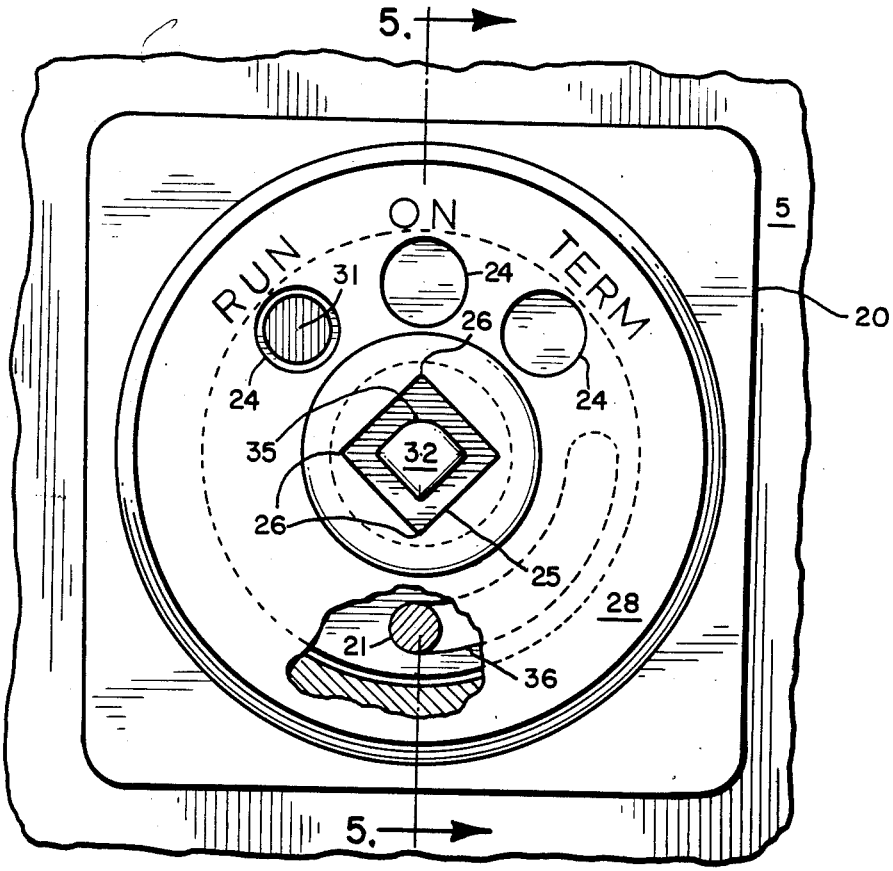

FIG. 5
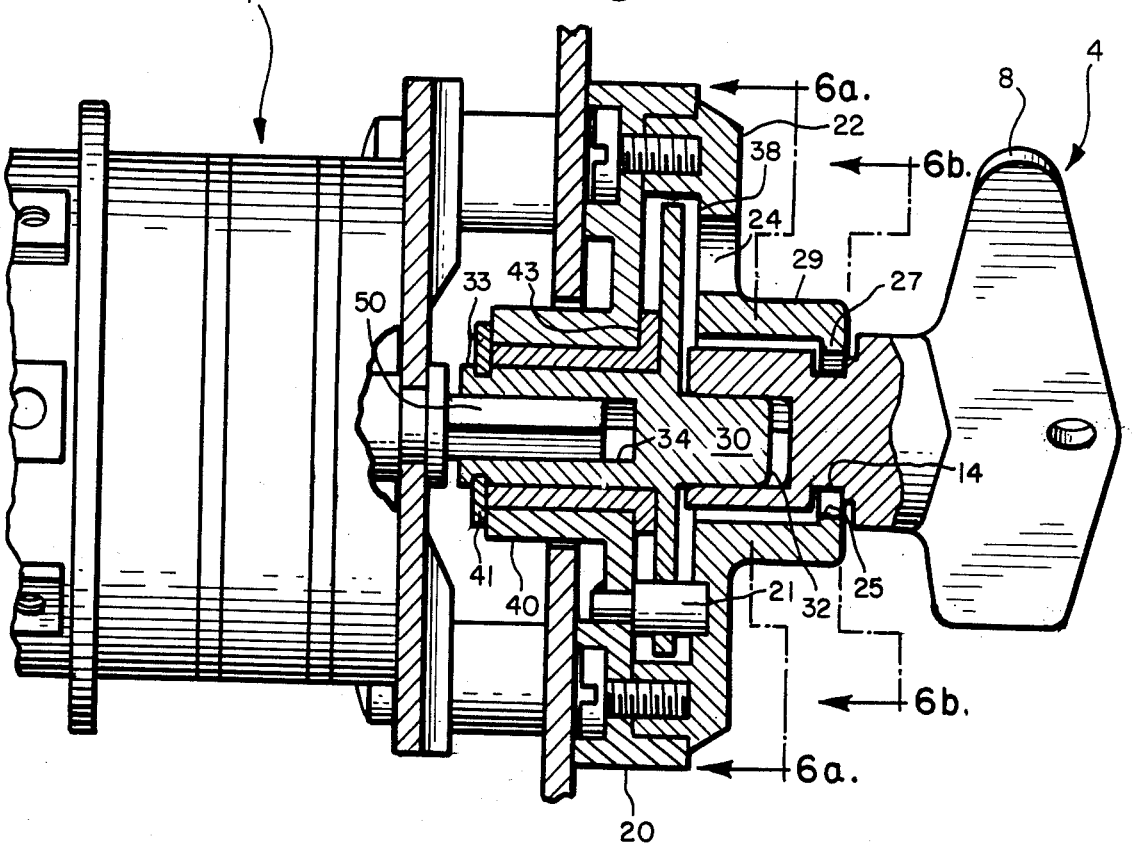
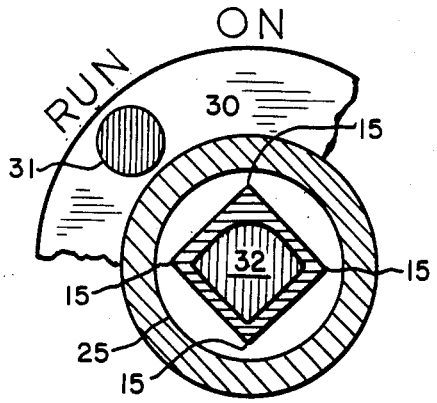
FIG. 6a
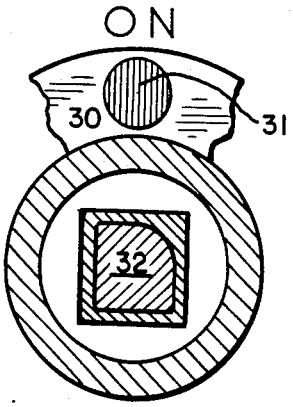
FIG. 7a
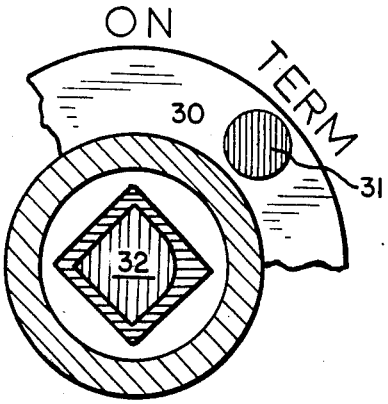
FIG. 8a
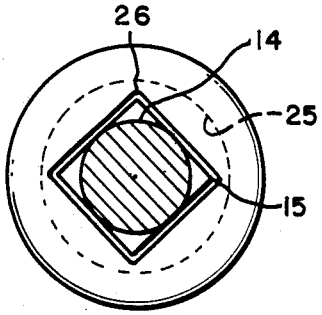
FIG. 6b
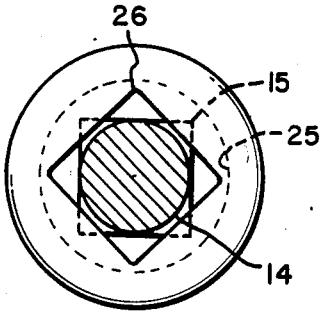
FIG. 7b
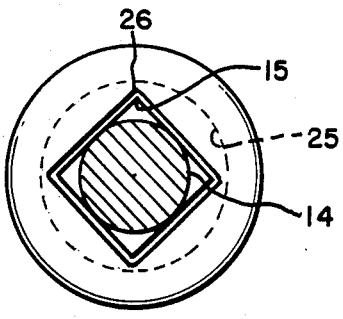
FIG. 8b

ELECTROMECHANICAL SWITCH ACTUATOR HAVING HIGH SECURITY KEY ACTUATOR

BACKGROUND OF THE INVENTION

This invention relates generally to key operated mechanical actuators for electrical switches, and more particularly pertains to a key operated switch actuator used as a "door control switch" on mass transit vehicles such as subway cars.

Door control switches are well known and many are in common use on mass transit vehicles. In this application, a rugged, easy to operate, key operated switch is required to provide access to transit cars by authorized transit authority personnel as required for efficient train operation and maintenance. An earlier crew switch of this type is disclosed and claimed in U.S. Pat. No. 4,153,826, assigned to the same assignee as this application. U.S. Pat. No. 4,153,826 is hereby incorporated by reference.

The switch disclosed in U.S. Pat. No. 4,153,826, although providing satisfactory operation, has, due to changing requirements of the transit industry, substantial shortcomings in that more complex train control systems require a greater number of circuits, resulting in use of the multiple stack rotary electromechanical switch, typically operated by the actuator disclosed herein. Key operation in order to prevent train operation by unauthorized personnel is also required.

Present efforts to utilize electromechanical switches such as the "electroswitch" series 31 operated by a conventional high security lock such as the Chicago Lock Company number 4188, or other use of a high security lock actuator have not been particularly successful. Primary deficiencies encountered in utilizing these conventional locks to operate an electromechanical switch include short switch life due to excessive force transmitted through key operation. Also, conventional high security keys cannot withstand the relatively rugged conditions surrounding transit car use by operating personnel.

It is therefore the object of this invention to provide a highly reliable, simple, mechanically rugged electromechanical switch actuator, operated by a detachable key.

It is a further object of this invention to provide an electromechanical switch actuator having a retained operating key for predetermined switch positions.

It is a further object of this invention to provide an electromechanical switch actuator having a non-electrical switch position indicator independent of key presence.

It is yet an additional object of this invention to provide an electromechanical switch actuator wherein the switch function or position is indicated by key orientation.

It is a further object of this invention to provide an electromechanical switch actuator wherein the mechanical operating key forces are converted entirely into rotational torque.

It is another object of this invention to provide an electromechanical switch actuator wherein an operating key introduced external the car body operates a switch entirely internal of the car body.

SUMMARY OF THE INVENTION

The key operated switch actuator disclosed and claimed utilizes a simple, detachable key introduced coaxial to an intermediate key stop plate. The stop plate is contained internal of an escutcheon and carries, on its periphery, an indicator marking visible through apertures in the escutcheon in order to provide indication of switch position. The key stop plate mechanically couples the actuating key and switch shaft. A thrust bearing is disposed coaxial of both the switch shaft and operating key end so as to absorb all external forces encountered in key introduction and rotation external the car body.

The operating key provided incorporates a partial internal cavity and axially displaced peripheral groove at its operating end. The key head or operating lever has a switch position indicator in alignment with apertures in the escutcheon so as to provide remote visual indication of the switch position through observation of the key head orientation.

The key stop plate further incorporates a segmental groove coaxially disposed to its operating shaft for engaging a stop pin affixed to the actuator housing. The escutcheon plate incorporates a centrally located stud or boss which mechanically cooperates with the key groove in order to prevent removal of the key. When actuated, predetermined switches have established electrical circuits.

A flat or other non-right angle end on one corner of the escutcheon corresponds to an identical flat internal of the operating key bore, allowing key insertion in a predetermined angular position.

BRIEF DESCRIPTION OF THE DRAWINGS

Other objects and advantages of the key operated electromechanical switch actuator disclosed herein will become apparent upon reading the following detailed description with indicated reference to the drawings, in which:

FIG. 1 is a perspective view of the actuator/switch combination particularly showing the key in an axially displaced position.

FIG. 2 is a plan view of the switch actuator particularly showing switch contacts indicated in the "RUN" position. Also shown in a partial section, is the switch limit stop for the indicated position.

FIG. 3 is a perspective view of the key actuator in partial section, particularly showing the key retaining groove and internal key bore.

FIG. 4 is a partial section of the operating key of FIG. 3, particularly showing the locating flat of one corner in the key bore.

FIG. 5 is a partial cross-section of the actuator/-switch combination particularly showing the coaxial disposition of the operating key, the key stop plate, and associated thrust absorbing members.

FIG. 6*a* is a partial section of the key actuator assembly of FIG. 5, showing the key in the "RUN" position.

FIG. 6*b* is an additional cross-section of the assembly of FIG. 5, particularly showing the relationship between the key locking groove and the key stop plate aperture.

FIG. 7*a* is a further cross-section similar to that of FIG. 6*a*, however showing the switch in the "ON" position.

FIG. 7*b* is a partial cross-section of the assembly of FIG. 5, similar to that of FIG. 6*b*, however showing the key retained in the "ON" position.

FIG. 8*a* is a partial cross-section of the assembly of FIG. 5, similar to that of FIG. 7*a*, however showing the switch in the "TERM" position.

FIG. 8*b* is an additional partial cross-section of the assembly of FIG. 5, similar to that of FIG. 7*b*, however showing the key in a non-retained position, associated with the "TERM" switch position.

DETAILED DESCRIPTION OF THE INVENTION

In initial reference to FIG. 1, the electromechanical switch assembly 2 is shown operatively connected to a typical rotary electromechanical switch assembly 7. Intermediate the actuator and switch assembly is a mounting panel 5 providing mechanical support. It should be noted that the switch assembly 7, although shown as a rotary drum-type electrical switch, as those skilled in the art will readily see, could be another type of switch actuating combination arranged so as to be operable by a rotating shaft. These alternates would include cam operated switches, for sliding contact drum constructions such as the typical wafer type.

An actuator operating key assembly 4 is shown in FIG. 1 spaced from the switch assembly 2 but in axial alignment with the switch assembly 2 to indicate the relationship between the key assembly 4 and the switch assembly 2. Proper operating locations of the key actuator and switch are shown by FIG. 5.

The key assembly includes an operating handle 6, having an indicator portion 8, and key handle operating shaft 10. The operating shaft 10 has, opposite said key handle, an operating key insert assembly 12. A concentric operating shaft groove 14 is located intermediate said key handle indicator and operating key insert assembly 12. The key insert assembly further includes an operating key insert bore or cavity 16, having a generally square cross-section. It should be noted that the operating key bore 16 further includes three essentially right-angle corners 17, and one rounded and/or flattened corner 18 (reference FIG. 4).

With particular reference to FIGS. 2 and 5, the switch actuator of the invention incorporates an escutcheon 22, having a front face 28. Defined by said front face are indicator apertures 24, designated by the words "RUN", "ON", and "TERM". Although these descriptions provide information relating to switch positions for a particular embodiment, those ordinarily skilled in the art will readily see that other designations particular to a given switch application can be incorporated as well. On the escutcheon front face 28, a centrally located, somewhat tubular protuberance 29, projecting from the surface of face 28 has, at its outer end, a key inlet opening or aperture 25, having a generally rectangular shape. The corners of the key inlet 26, in the preferred embodiment, are essentially ninety degree angles.

Turning now to FIG. 5 and, more particularly, the switch assembly cross-section with some reference to sectional FIGS. 6*a*, 6*b*, 7*a*, 7*b*, 8*a*, and 8*b*, coaxially disposed between the electromechanical switch actuator housing 20, and the escutcheon 22 is a generally circular key stop and indicator plate 30. As shown, the indicator plate 30 includes a disc-like indicator face 38, having at least one visual indicating spot 31, arranged to be in alignment with the escutcheon face apertures 24 for predetermined positions of the switch contacts. Switch stop plate 30 further includes a key actuator boss or projecting shaft 32 coaxially aligned with the escutcheon key inlet aperture 25.

With particular reference to FIGS. 2 and 5, the switch stop plate 30 incorporates a generally arc-like aperture 36, located concentric of and radially spaced from the rotating center of the switch stop plate actuator shaft 32. A stop pin 21 extends from the housing 20 into said stop groove so that the pin 21 abuts the stop groove ends, thereby limiting rotary or angular motion of the key stop plate actuator shaft 32. The arc length of the stop groove 36 is chosen so as to predetermine rotary motion of the shaft 32 when actuated by the key assembly 4. Contact of the ends of the groove 36 and abutting surfaces of the pin 21 serve to absorb excessive forces which might be imposed on the switch assembly 7 through rotation of the operating key 4.

The combination of a positive rotary stop, and bearing supports provided by the key stop bearing 40 effectively prevent transmission of excessive rotary and bending torques from the operating key 4 to the switch shaft 50, thus substantially improving the switch life.

The key stop plate 30 also incorporates a projecting switch shaft 33 in axial alignment with the key actuator shaft 32. The switch shaft 33 further incorporates a switch actuating bore or cavity 34, also in axial alignment with the key actuator shaft 32. As shown, the electromechanical switch shaft 50 is telescoped by the bore of cavity 34. Suitable means for preventing motion between the switch shaft 50 and stop plate 30 are provided. The stop plate shaft 33 is journaled internal of the switch actuator housing 20 by a shouldered bearing 40. Lateral motion of the bearing 40 is prevented through the use of a grooved retaining washer 41, at the switch end, and a distal shoulder 43. This retained bearing essentially prevents transmittal of actuating key forces to the switch shaft 50, resulting in application of only rotary torque when operating the switch assembly 7.

With particular reference to the above mentioned sectional drawings 6*a*, 6*b*, 7*a*, 7*b*, 8*a*, and 8*b*, indication of the switch position is accomplished through key insertion and operating key retention by the escutcheon boss 29 at selected switch positions, is provided as follows;

With particular reference to FIGS. 6*a* and 6*b*, location of the key actuator boss or shaft 32, with the key assembly 4 in its actuating location, is shown in the "RUN" position. For the "RUN" position then, the key stop plate indicator 31 is in alignment with the "RUN" aperture 24, providing visual indication of switch condition. The operating key handle shaft shoulders 15 are, as indicated, in alignment with the corners 26 of the escutcheon key stop indicator face 38 and, with particular reference to FIG. 6*a*, the key insert bore flat 18 is in alignment with the key stop plate actuator shaft flat 35, thereby allowing insertion of the key with the indicator portion 8 of the actuating key handle aligned with the now visible key stop plate indicator 31.

In reference to FIG. 6*b*, in the "RUN" position, the key insert corners 15 are in alignment with the escutcheon key aperture corners 26, thereby allowing insertion and rotation of the key insert assembly to its position in a telescoping relationship with the key stop plate shaft 32, as shown by FIG. 5. It should be noted that the actuating key shaft groove 14 essentially surrounds the escutcheon key inlet aperture 25, with sufficient clearance to allow rotation of the operating key in its inserted position.

Rotation of the operating key 4 to the "ON" position, as shown by FIGS. *7a* and *7b*, the key insert corners 15 rotate inside the key stop plate cavity 34, to a position where corners 15 will occupy a position such that a corner lies behind the edge 27 of escutcheon key inlet aperture 25, thereby capturing the key internal of the escutcheon key boss or projection 29. Rotation of the key from "RUN" to "ON" has also resulted in movement of the electromechanical switch shaft 50 to a predetermined electrical circuit arrangement corresponding to "ON". This is accomplished by the driving engagement of the key actuator shaft 32 and the key insert bore or cavity 16.

Similarly, rotation of the actuating key assembly 4 moves the visual indicator 31 to its "TERM" position, thereby providing a predetermined change in electrical circuitry and, more significantly, moving the key insert corners 15 to a non-capture position in alignment with the escutcheon plate aperture 24, allowing key withdrawal.

In operation, operation of the switch assembly 6 by a key assembly 4 through insertion in the key operated actuator 2, is conveniently accomplished by key insertion limited to a predetermined relationship between the electrical circuitry and the visual indicator 31. Key withdrawal is prevented after rotation to the "ON" position, while rotation to the "TERM" position again enables withdrawal of the actuating key 4. It is important to note that, throughout the operating sequence of this embodiment, the condition of the electrical circuits established by the switch assembly 7 can be noted by visual appearance of the indicator 31, and/or the indicator portion 8 of the actuating key assembly 4.

Relative dimensions of the key insert operating shoulders 15, and the key stop plate operating shaft 32, in relation to the operating key cavity 16 and its related shoulders 17, are such that commonly available tools providing sufficient force to rotate the actuator cannot be used. This novel approach to limiting operation of power doors in modern, sophisticated, transit car systems provides a unique combination of security, convenient operation, and reliable, rugged switch/operating key interface.

Thus, it is apparent that there has been provided in accordance with the invention, a novel key operated electromechanical switch actuator, that fully satisfies the objects, aims, and advantages as set forth above. While the invention has been described in conjunction with a specific embodiment thereof, it will be evident to those skilled in the art that many alternatives, modifications, and variations are possible given the concepts and details disclosed in the foregoing description. Accordingly, it is intended to embrace all such alternatives, modifications, and variations as fall within the spirit and broad scope of the appended claims.

Therefore, what is claimed is:

1. An electromechanical switch actuator, of the type operated by a detachable key, for controlling angular positioning of a component of an electromechanical switch, said actuator comprising:

an actuator housing;

an escutcheon mounted on said housing and defining therewith a cavity, said escutcheon having an indicator face and a generally tubular, open-ended boss extending forwardly of said indicator face; and a switch stop plate rotatably mounted in said cavity, said plate having a front surface and a rear surface, said plate having a forward shaft extending from said front surface and into said boss and terminating short of the open end of the boss, said plate further having a rear shaft in axial alignment with said forward shaft, said rear shaft projecting from said rear surface and having a cavity for non-rotatably receiving said electromechanical switch component, said plate front surface having a visually prominent indicating spot and said escutcheon having a plurality of apertures intersecting said indicator face, said spot being aligned to appear in each of said apertures depending on the angular position of said forward shaft whereby said actuator provides visual indication of the angular position of said switch component.

2. An actuator as set forth in claim 1 further comprising means holding said plate against substantial axial movement, said plate bearing against said housing so that axial forces applied to said plate are not transmitted to said component of said switch.

3. An actuator as set forth in claim 1 wherein said forward shaft has a number of spaced peripheral projections.

4. An actuator as set forth in claim 3 further including an actuator key comprising:

an insert end having a number of corner-like projections on its outer surface;

a cavity in said insert end for receiving said forward shaft, said last-mentioned cavity having internal corners corresponding in location and number to said forward shaft peripheral projections but being at least one less in number than the number of outer surface corner-like projections;

a handle end remote from said insert end and having an indicating portion; and an intermediate portion joining said insert end and said handle end, said intermediate portion including a groove on its outer surface.

5. An actuator as set forth in claim 4 wherein said boss has a forward end wall defining the boss end opening, said end wall having internal corners corresponding in number and location to the corner-like projections of said insert end so that in predetermined relative orientations of said insert end and said end wall, said insert end can pass said forward end wall; and so that in other relative orientations of said insert end and said end wall, said insert end cannot pass said end wall and said key is retained by said boss.

* * * * *

REEXAMINATION CERTIFICATE (1135th)

United States Patent [19] [11] B1 4,611,104

Reddy [45] Certificate Issued Sep. 26, 1989

[54] ELECTROMECHANICAL SWITCH ACTUATOR HAVING HIGH SECURITY KEY ACTUATOR

[75] Inventor: Redreddy S. Reddy, Evanston, Ill.

[73] Assignee: Vapor Corporation, Chicago, Ill.

Reexamination Reqs:st:
No. 90/001,653, Nov. 29, 1988
No. 90/001,696, Jan. 25, 1989

Reexamination Certificate for:

| | |
|---|---|
| Patent No.: | **4,611,104** |
| Issued: | **Sep. 9, 1986** |
| Appl. No.: | **784,486** |
| Filed: | **Oct. 4, 1985** |

[51] Int. Cl.[4] ..... H01H 27/08
[52] U.S. Cl. ..... 200/43.08; 200/308

[58] Field of Search ..... 200/43.01, 43.04, 43.08, 200/61.64, 308, 334, 336; 70/345, 346, 432, 441

*Primary Examiner*—Renee S. Luebke

[57] ABSTRACT

An electromechanical switch actuator operated by a detachable, mechanical key providing security against unauthorized operation. The switch actuator disclosed is of particularly rugged construction, arranged to provide rotary torque for operating axially coupled electromechanical rotary switches having a plurality of switch banks or stacks disposed along a central axis. Switch operation is provided for any predetermined number of switch positions with non-electric indication of said positions, both by visual observation of the key entry area, and the key position. Key operating forces are converted entirely to rotational torque for switch operation and positive rotary motion limits independent of the electrical switch provide substantially increased switch life.

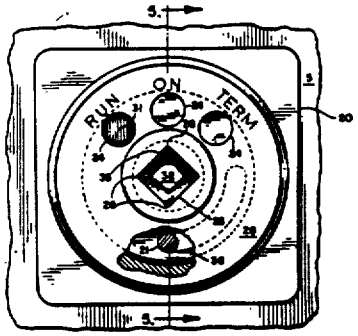

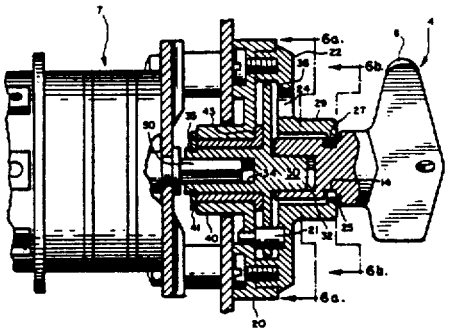

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1-5 is confirmed.

* * * * *